US006724999B2

(12) United States Patent
Kikuchi et al.

(10) Patent No.: US 6,724,999 B2
(45) Date of Patent: Apr. 20, 2004

(54) FIXING APPARATUS

(75) Inventors: Kazuhiko Kikuchi, Yokohama (JP); Toshiya Inomata, Kawasaki (JP); Osamu Takagi, Tokyo (JP); Satoshi Kinouchi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/126,618

(22) Filed: Apr. 22, 2002

(65) Prior Publication Data

US 2003/0198481 A1 Oct. 23, 2003

(51) Int. Cl.[7] ..... G03G 15/20
(52) U.S. Cl. ..... 399/69; 399/328
(58) Field of Search ..... 399/67, 69, 70, 399/320, 328, 330, 334, 335, 336, 338; 430/124; 347/156; 219/216

(56) References Cited

U.S. PATENT DOCUMENTS 5,526,103 A * 6/1996 Kato et al. ..... 399/328
5,752,150 A 5/1998 Kato et al.
5,822,669 A * 10/1998 Okabayashi et al. ..... 399/330
6,188,054 B1 * 2/2001 Ohta ..... 219/216
6,292,648 B1 * 9/2001 Higaya et al. ..... 399/335
6,298,215 B1 * 10/2001 Nomura et al. ..... 399/328
6,337,969 B1 1/2002 Takagi et al.
6,377,778 B1 4/2002 Kikuchi et al.

FOREIGN PATENT DOCUMENTS

JP 9-127813 5/1997
JP 9-258586 10/1997
JP 2000-206813 7/2000

* cited by examiner

*Primary Examiner*—Sandra Brase
(74) *Attorney, Agent, or Firm*—Foley & Lardner

(57) ABSTRACT

A fixing apparatus is provided with a fixing device which includes a fixing roller and a pressing roller pressed against the fixing roller, the fixing roller and the pressing roller defining a region through which sheets of various sizes pass while being heated, an induction-heating device which heats the fixing roller by induction heating and which includes first and second excitation coil units provided inside the fixing roller and spaced from each other by a predetermined distance in an axial direction of the fixing roller, and a control device which varies an output applied to the first and second excitation coils in accordance with a surface temperature as measured in the axial direction of the fixing roller. The first and second excitation coil units have widths which are greater than those of maximal-size sheets by 20 to 40 mm.

8 Claims, 9 Drawing Sheets

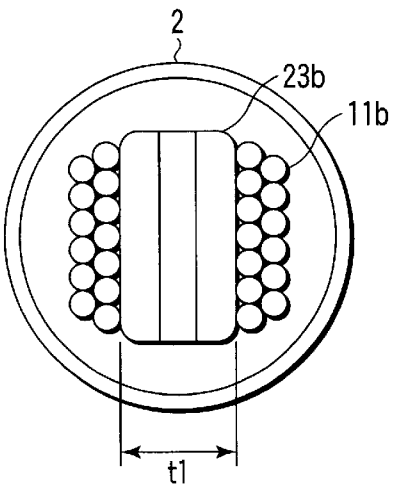
FIG. 8
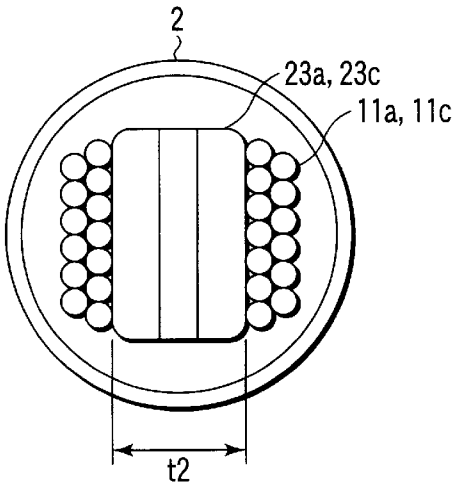
FIG. 9
| | Coil turns | L | R | Bobbin thickness | Output | | | | | | | | | |
|---|---|---|---|---|---|---|---|---|---|---|---|---|---|---|
| | | | | | 700 | 800 | 900 | 1000 | 1100 | 1200 | 1300 | 1400 | 1500 |
| Center | 14 | 24.7 | 1.07 | 25 | ○ | ○ | ○ | ○ | ○ | ○ | ○ | ○ | × |
| | | | | | | | | | | | | | |
| End | 11 | 24.6 | 0.80 | 25 | × | × | ○ | ○ | ○ | × | × | × | × |
| | 13 | 25.9 | 1.28 | 35 | × | ○ | ○ | ○ | ○ | ○ | ○ | ○ | ○ |
FIG. 10

FIXING APPARATUS

BACKGROUND OF THE INVENTION

The present invention relates to a fixing apparatus employed in an electrophotographic printer.

This type of fixing apparatus includes a metallic heating roller, and an elastic pressing roller which is pressed against the heating roller. The heating roller contains a halogen lamp or the like and is heated by the radiant heat of this halogen lamp.

A sheet to which a toner image is transferred is made to pass through the region between the heating roller and the pressing roller. At the time, the sheet is heated and pressed, as a result of which the toner image is fixed to the sheet.

In the conventional art, the light radiating from the halogen lamp warms the air inside the heating roller. Since the heating roller is heated in this manner, there is inevitably a loss of energy when light is converted into heat, and the heat cannot be transmitted to the heating roller with high efficiency. Hence, the thermal conversion efficiency is as low as 60–70% and the energy saving characteristic is poor.

Due to the low thermal efficiency, the warm-up operation of the fixing apparatus is inevitably long.

In recent years, therefore, a heater-type fixing apparatus employing a cylindrical heat-resistant film has been put to practical use. The fixing apparatus comprises a heating member including linearly-arranged heating elements, and a heat-resistant film movable in the state where it is in tight contact with the heating member. A sheet to which an image is to be fixed is brought into tight contact with the heating member, with the heat-resistant film interposed therebetween. By moving the heating member together with the heat-resistant film, the thermal energy of the heating member is transmitted to the image through the heat-resistant film.

In the fixing apparatus described above, the linearly-arranged heating elements of the heating member must be controlled in such a manner that the temperature distribution becomes uniform in the longitudinal direction of the heating member. Therefore, apparatuses that have been manufactured must have uniform characteristics, and when operating them, temperature control must be executed with high accuracy. For these reasons, the manufacturing cost is inevitably high. In a high-speed copying machine, the heating member must be a high-power type, and the use of such a heating member is not desirable so as to reduce the power consumption.

In an effort to solve these problems, fixing apparatuses using induction-heating technology have been developed, such as those disclosed in Jpn. Pat. Appln. KOKAI Publications No. 9-258586 and No. 8-76620.

In the apparatus disclosed in Jpn. Pat. Appln. KOKAI Publication No. 9-258586, a coil assembly is formed by providing a coil around a core extending along the axis of rotation of a fixing roller. The coil assembly generates an eddy current supplied to the fixing roller.

In the apparatus disclosed in Jpn. Pat. Appln. KOKAI Publication No. 8-76620, a conductive film is heated by a magnetic field-generating means, and a recording medium is brought into tight contact with the heated conducted film, for fixing. A heat-generating belt is sandwiched between a pressing roller and members with which magnetic field-generating means is assembled, in such a manner as to form a fixing nip portion.

In the prior art, however, the fixing roller or the heat-generating belt is heated uniformly without reference to the sizes of sheets. In other words, it is heated uniformly at any width position (the width being perpendicular to the sheet feeding direction). For this reason, when sheets of various sizes are passed through the fixing apparatus, the surface temperature of the fixing roller or heat-generating belt may not be even, and a reliable fixing operation cannot be expected.

BRIEF SUMMARY OF THE INVENTION

The present invention has been conceived in consideration of the above circumstances, and an object of the invention is to provide an induction-heating type fixing apparatus which does not give rise to uneven surface temperature distribution and thus ensures a reliable fixing operation for sheets of various kinds.

A fixing apparatus according to one aspect of the present invention comprises: a fixing device which includes a fixing roller and a pressing roller pressed against the fixing roller, the fixing roller and the pressing roller defining a region through which sheets of various sizes pass while being heated; an inductionheating device which heats the fixing roller by induction heating and which includes first and second excitation coil units provided inside the fixing roller and spaced from each other by a predetermined distance in the axial direction of the fixing roller; and a control device which controls or varies an output applied to the first and second excitation coils in accordance with a surface temperature as measured in the axial direction of the fixing roller, the first and second excitation coil units having widths which are greater than those of sheets of maximal size by 20 to 40 mm.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 8 is a sectional view of the center coil unit.

FIG. 9 is a sectional view of one end coil unit.

FIG. 10 shows heating outputs in relation to the thickness of the bobbins of the coil unit.

DETAILED DESCRIPTION OF THE INVENTION

Figure 1:
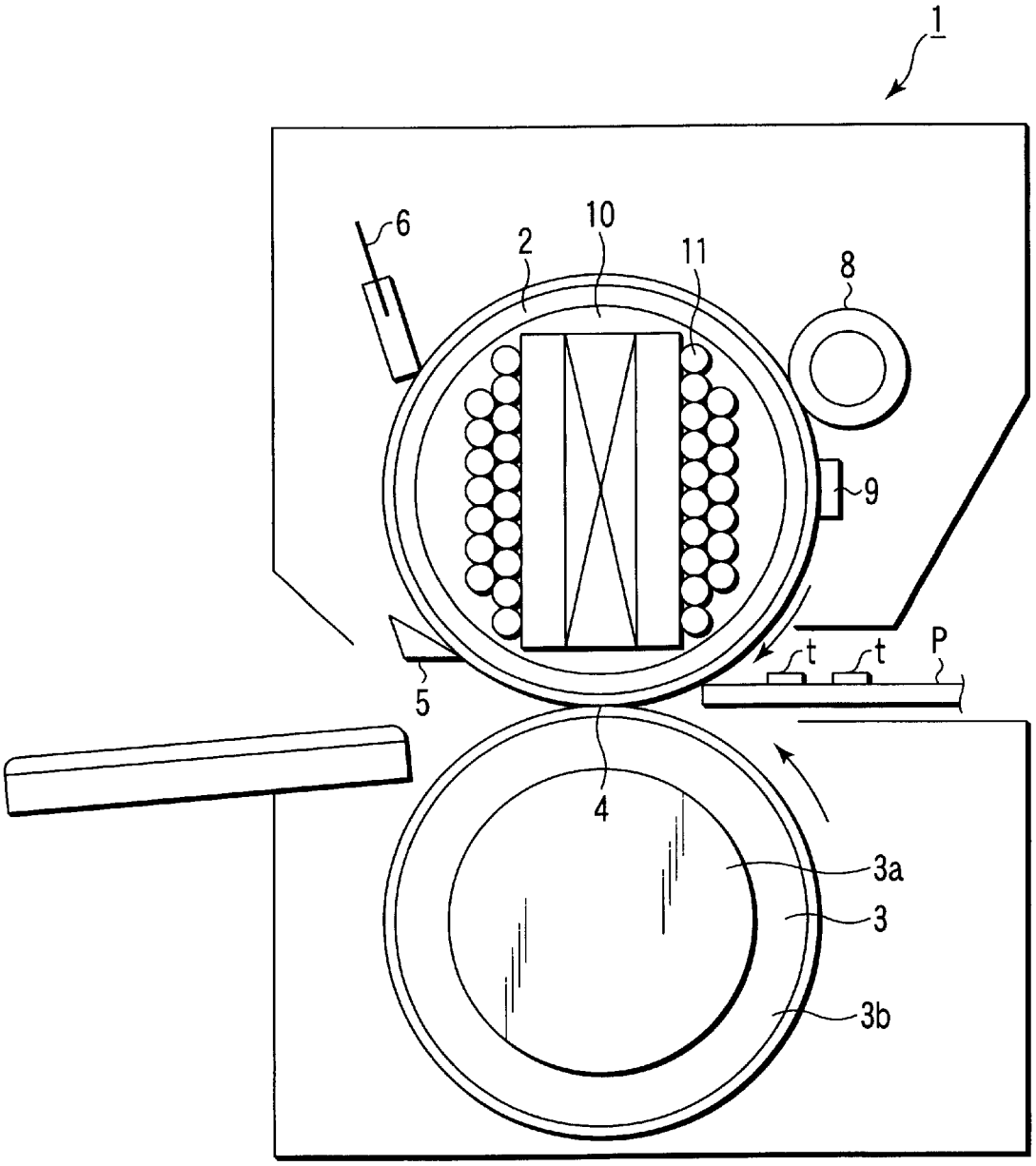
FIG. 1 is a schematic illustration showing the entire induction-heating type fixing apparatus according to one embodiment of the present invention.

The present invention will be described in detail, referring to the embodiments shown in the drawings.

FIG. 1 is a sectional view schematically showing an induction-heating type fixing apparatus according to the first embodiment of the present invention.

The fixing apparatus 1 comprises a heating roller 2 (ϕ60 mm) serving as a fixing roller, and also comprises a pressing roller 3 (ϕ60 mm). The pressing roller 3 is pressed against the heating roller 2 by a pressure-applying mechanism (not shown) in such a manner as to form a predetermined nip width. The heating roller 2 is rotated by a driving motor in the direction indicated by an arrow, and the pressing roller 3 is rotated in the direction indicated by another arrow in accordance with the rotation of the heating roller 2.

In general, the heating roller 2 is formed of an iron material having a thickness of about 0.5 to 3.0 mm. In the present invention, it is formed of an iron material having a thickness of 1.5 mm. A parting layer, such as a Teflon layer, is formed on the surface of the roller 2.

In the present embodiment, iron is used as the material of the roller. Other than this, stainless steel, aluminium, or a composite material including these may be used. The pressing roller 3 comprises a metallic core 3*a* and an elastic member 3*b* formed around the metallic core 3*a*. The elastic member 3*b* is formed of silicone rubber, fluororubber, or the like.

When a sheet P, on which a toner image t is to be fixed, passes through a fixing point (a nip position) where the heating roller 2 and the pressing roller 3 are pressed against each other, the toner image t on the sheet P is melted and pressed, whereby it is fixed on the sheet P.

A separation claw 5 and a cleaning member 6 are in contact with the circumferential surface of the heating roller 2 at positions which are downstream of the contact position (nip position) between the heating roller 2 and the pressing roller 3, with respect to the rotating direction. The separation claw 5 separates a sheet P from the heating roller 3, and the cleaning member 6 cleans away the toner, paper particles or dust offset on the heating roller 2. A parting agent-coating device 8 and a thermistor 9 are disposed at positions which are downstream of the cleaning member 6 with respect to the rotating direction of the heating roller. The parting agent-coating device 8 coats an offset-preventing parting agent and the thermistor 9 detects the temperature of the heating roller 2.

Inside the heating roller 2, a magnetic field generating means (hereinafter referred to as an induction-heating coil) 10 extends in the axial direction. The induction-heating coil 10 includes an excitation coil 11. The excitation coil 11 is formed using copper wire of 0.5 mm and is made as Litz wire including a number of insulated windings. In the present embodiment, the Litz wire is formed of ϕ0.5 mm wire and includes 19 turns in the case where 100V is applied. The wire is coated with heat-resistant polyimide.

When the excitation coil 11 is applied with a high-frequency current by an excitation circuit (inverter circuit) not shown, magnetic fluxes are generated. In order to prevent the magnetic fluxes from varying the magnetic field, the induction-heating coil 10 causes the heating roller to generate magnetic fluxes and an eddy current. The eddy current and the resistance of the heating roller cause Joule heat, as a result of which the heating roller 2 is heated. The surface temperature of the heating roller 2 is set or controlled to be a predetermined temperature. The surface temperature of the heating roller 2 is sensed by the thermistor 9, and information on the surface temperature is fed back when the heating roller 2 is heated.

When the surface temperature of the heating roller 2 reaches a predetermined temperature, a copying operation is started. When a sheet P passes through the fixing point (nip position) where the heating roller 2 and the pressing roller 3 are pressed against each other, the toner image t on the sheet P is melted and pressed, so that the toner image t is fixed.

Figure 2:
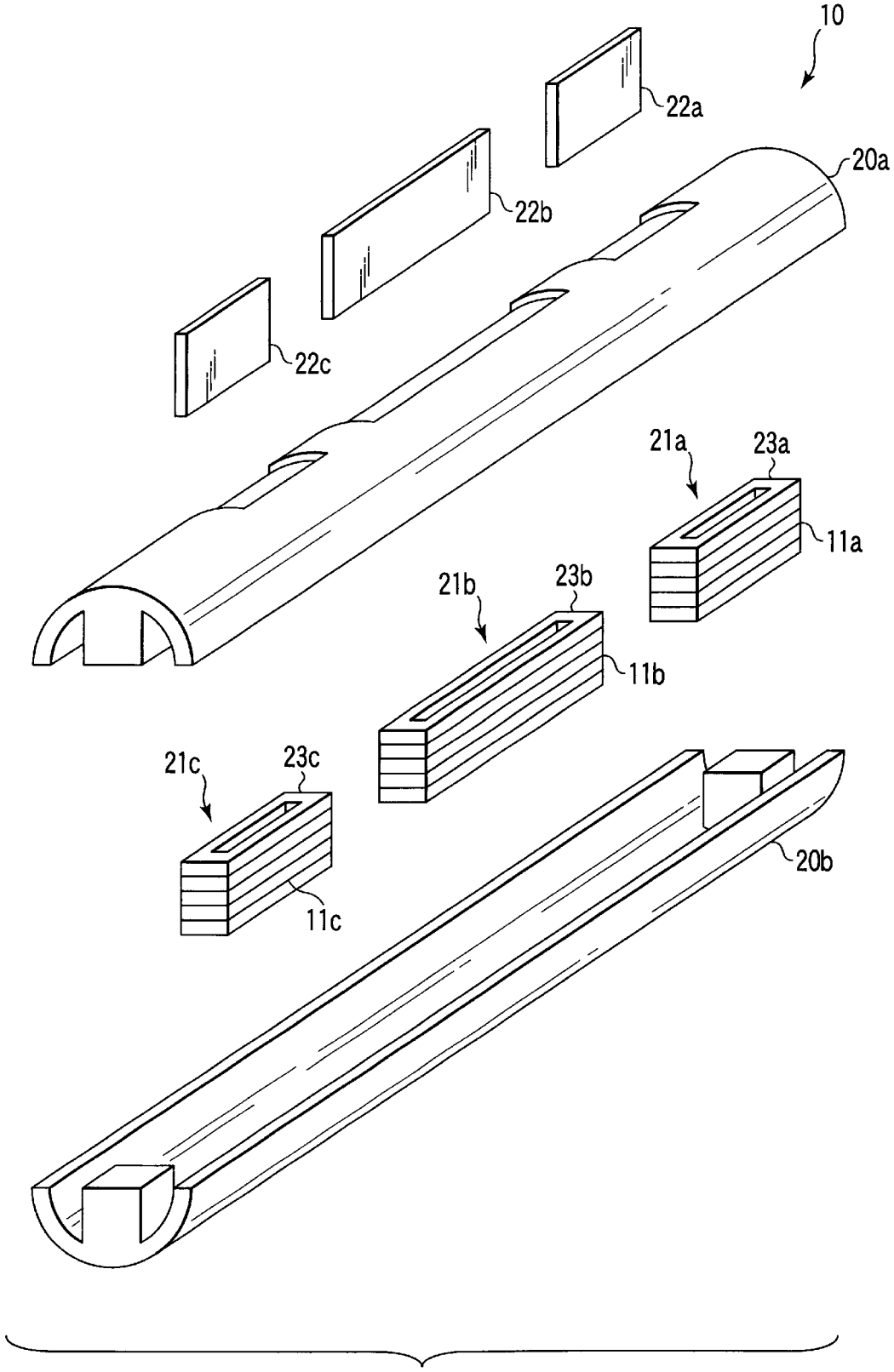
FIG. 2 is an exploded perspective view showing a two-part induction-heating coil provided for the induction-heating type fixing apparatus depicted in FIG. 1.

FIG. 2 is an exploded perspective view showing the induction-heating coil 10.

The induction-heating coil 10 includes: an upper holder 20*a* and a lower holder 20*b*, which are similar to each other; three coil units 21*a*, 21*b* and 21*c* sandwiched by the holders 20*a* and 20*b*; and core members 22*a*, 22*b* and 22*c* which are formed of ferrite and laminated steel. The coil units 21*a*, 21*b* and 21*c* are made up of coil units 21*a*, 21*b* and 21*c* and coil bobbins 23*a*, 23*b* and 23*c*, respectively.

An insulative sheet material (not shown) is inserted for insulation between the inner circumferential surface of the heating roller 2 and the excitation coils 11*a*, 11*b* and 11*c*. The holders 20*a*, 20*b* and the coil bobbins 23*a*, 23*b*, 23*c* are formed of insulating and heat-resistant resins or of materials with similar characteristics. Preferably, they are formed of the same material of the same coefficient of thermal expansion. As the resins, a ceramic material, a phenol, a liquid crystal polymer, an unsaturated polyester, etc. are used. The insulative sheet material has a heat-resistant temperature higher than the highest temperature the induction-heating coil 10 may have, and a breakdown voltage higher than the maximal voltage applied to the induction-heating coil 10.

Under these temperature conditions, the insulative sheet material has a shrinkage ratio of 2% or less and has a thickness of 0.4 mm or more. The insulative sheet material is PFA in the present embodiment, but may be PTFE or another kind of material as long as the material used satisfies the conditions described above.

The surface temperature of the heating roller 2 is controlled to be a predetermined value.

Thermistors, serving as temperature sensing means, are located at positions which are on the surface of the heating roller 2 and which oppose at least two of the three coil units 21*a* to 21*c*. The thermistors sense the surface temperature of the heating roller 2, and the center coil unit 21*b* and the end coil units 21*a* and 21*c* are alternately turned on and off. By performing duty control in this manner, the surface temperature of the heating roller 2 is kept constant.

Figure 3:
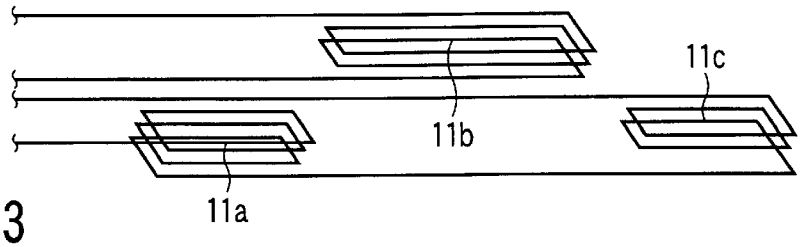
FIG. 3 is a perspective view showing the coil turns of the two-part induction-heating coil.

Of the three coil units 21*a* to 21*c*, those (21*a*, 21*c*) located at the end portions have their excitation coils 11*a* and 11*c* formed by use of a single electric wire and wound in the same direction, as shown in FIG. 3. This means that the coil bobbins 23*a*, 23*b* and 23*c* are made by two electric wires.

Figure 4:
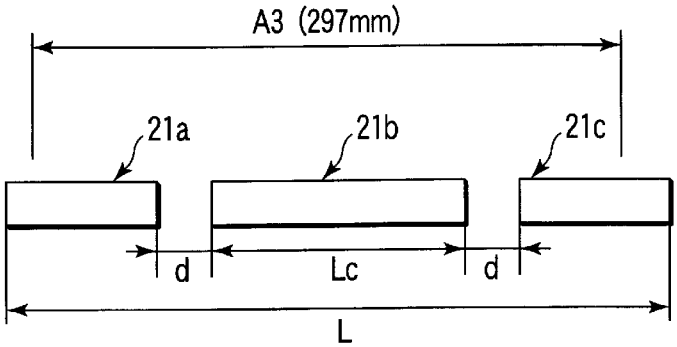
FIG. 4 shows how the center and end coil units of the two-part induction coil are arranged.

FIG. 4 shows how the center coil unit 21*b* and end coil units 21*a* and 21*c* are arranged. The arrangement of them is intended to minimize the uneven temperature distribution when the image forming apparatus uses sheets of various sizes. To be specific, the arrangement satisfies the following specifications:

(1) The overall width L determined by the coil units 21*a* to 21*c* is greater than the width of a maximal-size sheet by 30 mm±10 mm.

(2) Where the coil width Lc of the center coil unit 21*b* is in the range of 150 mm±10 mm, the distance d between the center coil unit 21*b* and the end coil units 21*a* and 21*b* is in the range of 5 to 25 mm.

Figure 5:
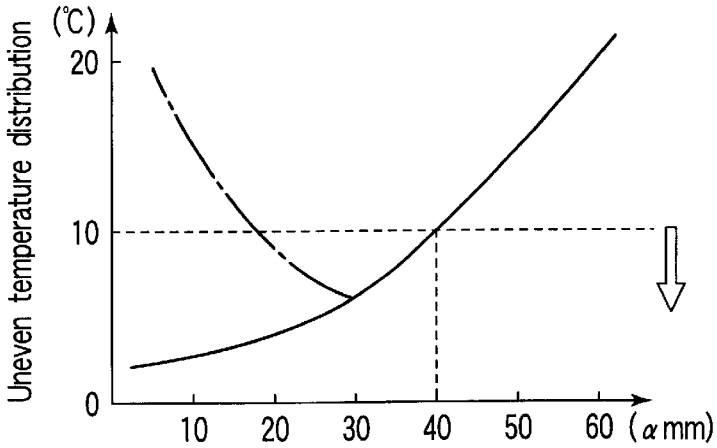
FIG. 5 is a graph showing how the width of the coil portion of the induction-heating coil and the uneven temperature distribution are related when sheets of various sizes are fed successively.

FIG. 5 is a graph showing how the overall width of the coil units 21*a*–21*c* of the induction-heating coil 10 and the uneven temperature distribution are related when sheets of various sizes are fed successively.

Where the value (a) obtained by subtracting 297 mm, which is the width of maximal-size (A3-size) sheets, from the total width L of the coil units 21*a*–21*c* of the induction-heating coil 10 is greater than 30 mm (i.e., where the total coil width L is greater than the width of the maximal-size sheets), the surface temperature becomes high at the end portions of the heating roller 2, i.e., at heating roller portions where sheets do not pass. As a result, the temperature distribution becomes uneven at the end portions. In this case, the temperature distribution is not very uneven at the sheet passage portions of the heating roller 2, but an increase in the temperature at the end portions may give rise to damage to the bearing, etc. On the other hand, where value $\alpha$ is less than 30 mm, the temperature of the heating roller 2 decreases at end portions which are within the width of A3-size sheets, so that the temperature distribution becomes more uneven (indicated by broken lines).

Figure 6:
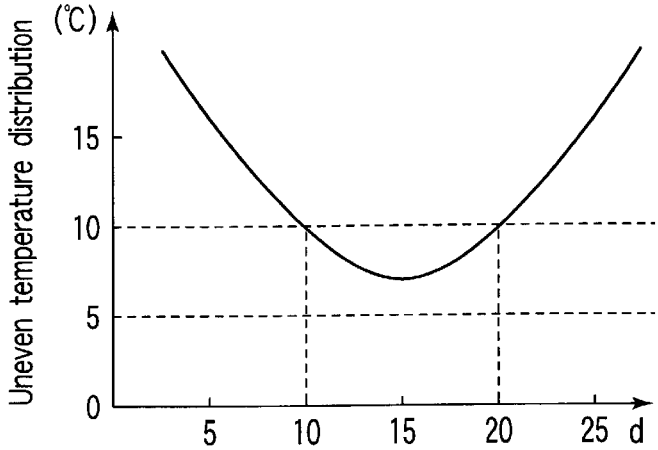
FIG. 6 is a graph showing how the distance between the center and end coils and the uneven temperature distribution are related when the width of the center coil unit is set at a value in the range of 150 mm±10 mm and sheets of various sizes are fed successively.

FIG. 6 is a graph showing how the distance d between the center coil 21*b* and end coils 21*a*, 21*c* and the uneven temperature distribution are related when the width of the center coil unit 21*b* is set at a value in the range of 150 mm±10 mm and sheets of various sizes are fed successively.

The center coil unit 21*b* and the end coil units 21*a* and 21*c* are alternately turned on. This means that the regions between the center coil unit 21*b* and the end coil units 21*a*, 21*c* are in the ON state at all times. If the distance between the center coil unit 21*b* and the end coil units 21*a*, 21*c* is short, the regions between them increase in temperature, resulting in an uneven temperature distribution. If the distance is long, the alternate switching of the coil units does not have much effects on the regions, and the regions decrease in temperature.

Figure 7:
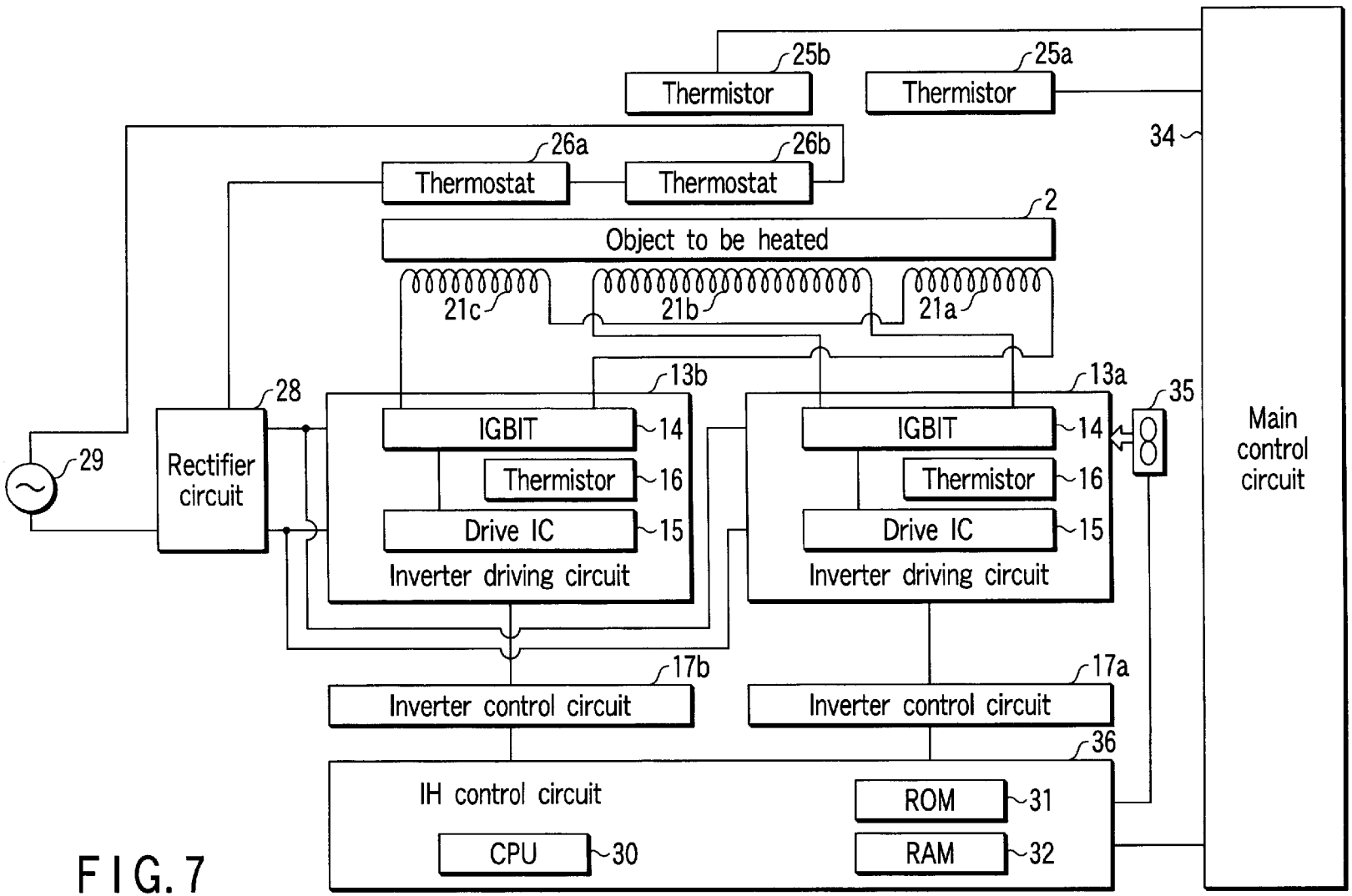
FIG. 7 is a block diagram illustrating the control system of the induction-heating fixing apparatus.

FIG. 7 is a block diagram illustrating the control system of the induction-heating fixing apparatus.

Thermostats 26*a* and 26*b* are connected in series to a power supply 29. Two inverter circuits 13*a* and 13*b* are connected to the power supply 29 by way of a rectifier circuit 28. The inverter driving circuits 13*a* and 13*b* serve as excitation circuits. Each of the inverter driving circuits 13*a* and 13*b* includes: an IGBT (Insulated Gate Bi-Polar Transistor) 14 which is applied with power from the rectifier circuit 28 and performs ON/OFF control of a high-frequency current supplied to the induction-heating coil units 21*a*, 21*b* and 21*c*; and a drive IC 15 which controls the ON/OFF operation of the IGBT 14. The inverter circuits 13*a* and 13*b* are connected to inverter circuits 17*a* and 17*b* to control operations.

Thermistors 16 are located in the neighborhood of the IGBTs 14, for sensing the ambient temperatures. When necessary, a fan 35 supplies air to the IGBTs 14 to prevent them from overheating.

Inverter driving circuit 13*b* is connected to the end coil units 21*a* and 21*c* of the induction-heating coil 10, while inverter driving circuit 13*a* is connected to the center coil unit 21*b* of the induction-heating coil 10. The inverter control circuits 17*a*, 17*b*, the fan 35 and the thermistors 16 are connected to an IH control circuit 36 to control their operations.

The IH control circuit 36 includes a CPU 30, a ROM 31 and a RAM 32. The ROM 31 stores a program required for controlling the induction heating. The CPU 30 performs a control operation in accordance with the program stored in the ROM 31. The RAM 32 stores data required for control processing, whenever necessary.

The IH control circuit 36 may be designed to be integral with a main control circuit 34, without departing from the intention of the present invention.

The surface temperature of the heating roller 2 can be kept uniform as follows. Outputs applied to the center coil unit 21*b* and the end coil units 21*a* and 21*c* are alternately switched based on a duty ratio in accordance with the temperatures sensed by the thermistor 25*b* located at a position corresponding to the center coil unit 21*b* and the thermistor 25*a* located at a position corresponding to one of the end coil units 21*a* and 21*c*. By this control, the surface temperature of the heating roller 2 can be kept constant and uniform.

FIGS. 8 and 9 are sectional views of a heating roller according to the second embodiment of the present invention.

Structural elements corresponding to those described in relation to the first embodiment will be denoted by the same reference numerals as used above, and a description of such structural elements will be omitted herein.

In the induction-heating coil 10 of the first embodiment, the center coil unit 21*b* differs from the end coil units 21*a* and 21*c* in terms of the widths of the coils 11*a*–11*c* they have, as shown in FIGS. 2 and 4. With this structure, the same performance cannot be attained from the coils unless their specifications are varied.

Even if the coils have the same value of inductance (L), which is a characteristic value determining the characteristics of them, they do not have the same performance (output range), as shown in FIG. 10, for example. This is because the numbers of turns that enable the end coil units 21*a*, 21*c* and the center coil unit 21*b* to have the same inductance L result in different values of impedance (R). That is, the impedance of the end coil units 21*a* and 21*c* is lower than that of the center coil unit 21*b*.

To solve this problem, coil bobbins that are different in thickness may be employed for the center coil unit 21*b* and the end coil units 21*a*, 21*c*, as shown in FIGS. 8 and 9. With this structure, the coils 11*a* and 11*c* of the end coil units 21*a* and 21*c* are closer to the inner circumferential surface of the heating roller 2. Since they are more closely related to the heating roller 2, the performance is enhanced, accordingly.

In the present embodiment, the thickness t1 of the bobbin 23*b* of the center coil unit 21*b* is set at 25 mm, and the thickness t2 of the bobbins 23*a* and 23*c* of the end coil units 21*a* and 21*c* is set at 30 mm. By virtue of this feature, the output range is widened, and a uniform balance is attained between the center coil unit 21*b* and the end coil units 21*a* and 21*c*.

Figure 11:
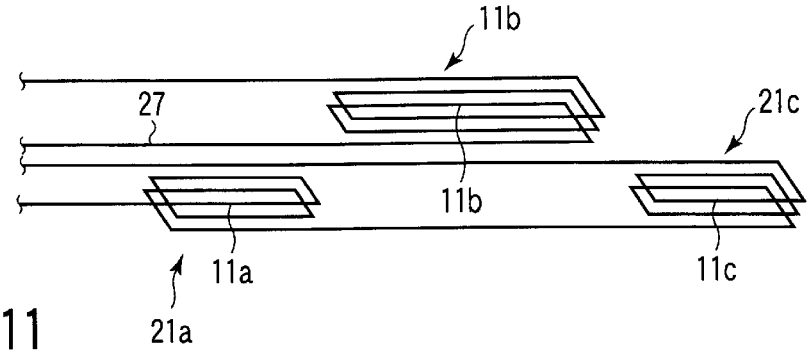
FIG. 11 is a perspective view illustrating a state where the end coil unit which the lead wires of the center coil unit pass by has a decreased number of coil turns.

FIG. 11 illustrates the third embodiment of the present invention.

The end coil units 21*a* and 21*c* of the induction-heating coil 10 of the first embodiment are under the influence of the coil lead wire 27 of the center coil unit 21*b*. To be more specific, the alternate On/Off control gives rise to the phenomenon that the apparent number of turns of the end coil unit 21*a* along which the coil lead wire 27 passes is greater than the actual number of turns. As a result, the temperature of the heating roller 2 is higher at the surface portions corresponding to the end coil 21*a* along which the lead wire passes than at the surface portions corresponding to the other coil unit 21*c*.

According to the third embodiment, therefore, the number of turns of the end coil unit 21*a* along which the coil lead wire 27 passes is smaller than that of the other end coil unit 21*c* by one.

Figure 12:
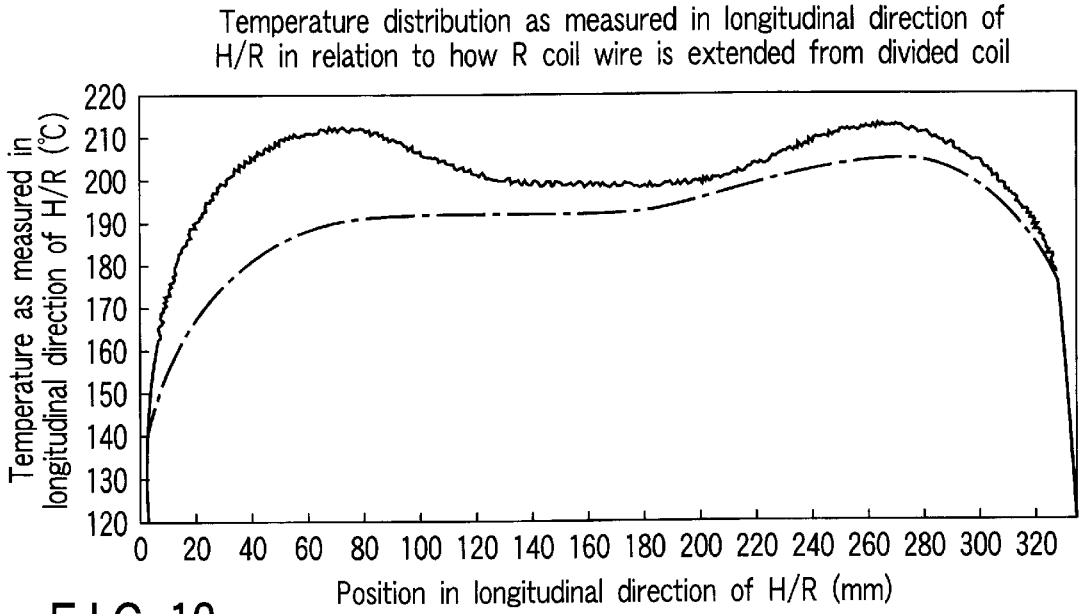
FIG. 12 is a graph showing how the temperature distribution of the heating roller is immediately after the warm-up operation, and showing how that temperature distribution differs between the case where the number of turns of the end coil unit along which the lead wire passes is changed and the case where the number of turns is not changed.

FIG. 12 shows how the temperature distribution of the heating roller is immediately after the warm-up operation, and illustrates how that temperature distribution differs between the following two cases: the case where the number of turns of the end coil unit 21*a* along which the coil lead wire 27 passes is smaller than that of the other coil unit 21*c* by one (the case is indicated by the solid line); and the case where the number of turns of the end coil unit 21*a* along which the coil lead wire 27 passes is equal to that of the other coil unit 21*c* (the case is indicated by the broken line).

As can be understood from FIG. 12, where the number of turns of end coil unit 21*a* is reduced by one, uniform temperature distribution is attained on the heating roller 2. It was confirmed that no problem occurred as long as the number of turns of coil unit 21*a* was changed within the range of 0.5 to 1.

Figure 13:
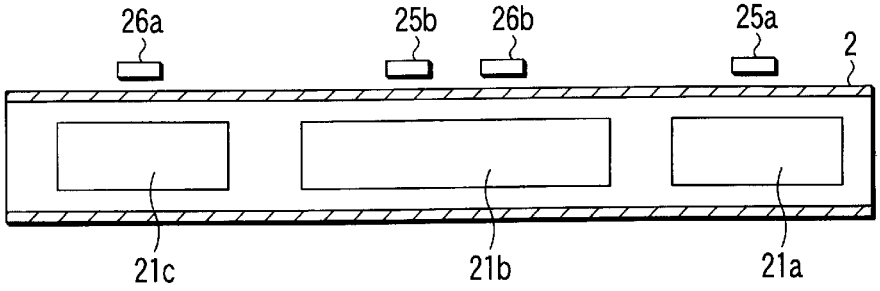
FIG. 13 shows an arrangement of a thermistor used for sensing the temperature of the heating roller and a thermostat used for detecting an abnormal temperature of the heating roller.

FIG. 13 shows the fourth embodiment of the present invention.

The fourth embodiment comprises: thermistors 25*a* and 25*b* which serve as temperature sensing means for sensing the surface temperature of the heating roller 2 for the purpose of surface temperature control; and thermostats 26*a* and 26*b* which serve as abnormal-temperature sensing means for sensing an abnormal temperature.

An abnormal temperature of the center coil unit 21*b* is sensed by thermostat 26*b*, and an abnormal temperature of the end coil units 21*a* and 21*c* is sensed by thermostat 26*a*. With this structure, it is possible to cope with the case where one of the two coil systems is in an abnormal state.

The thermistors 25*a* and 25*b* and thermostats 26*a* and 26*b* are substantially in phase with the heating roller 2. They are arranged to be substantially perpendicular to the longitudinal direction of the core members 22*a*–22*c* of the induction-heating coil 10. The thermistors 25*a* and 25*b* and thermostats 26*a* and 26*b* are set in a high temperature range when the heating roller 2 is not driven. This feature improves the temperature control accuracy of the heating roller 2, and further enables quick sensing of an abnormal state.

The thermistors 25*a* and 25*b* and thermostats 26*a* and 26*b* are arranged in a direction orthogonal to the sheet feed direction.

Thermistor 25*b* and thermostat 26*b* are located at a position facing substantially the central portion of the center coil unit 21*b*, thermistor 25*a* is located at a position facing substantially the central portion of one 21*a* of the coil units, and thermostat 26*a* is located at a position facing substantially the central portion of the other end coil units 21*c*. This structure can detect an abnormal state of only one of the end coil units 21*a* and 21*c*.

Figure 14:
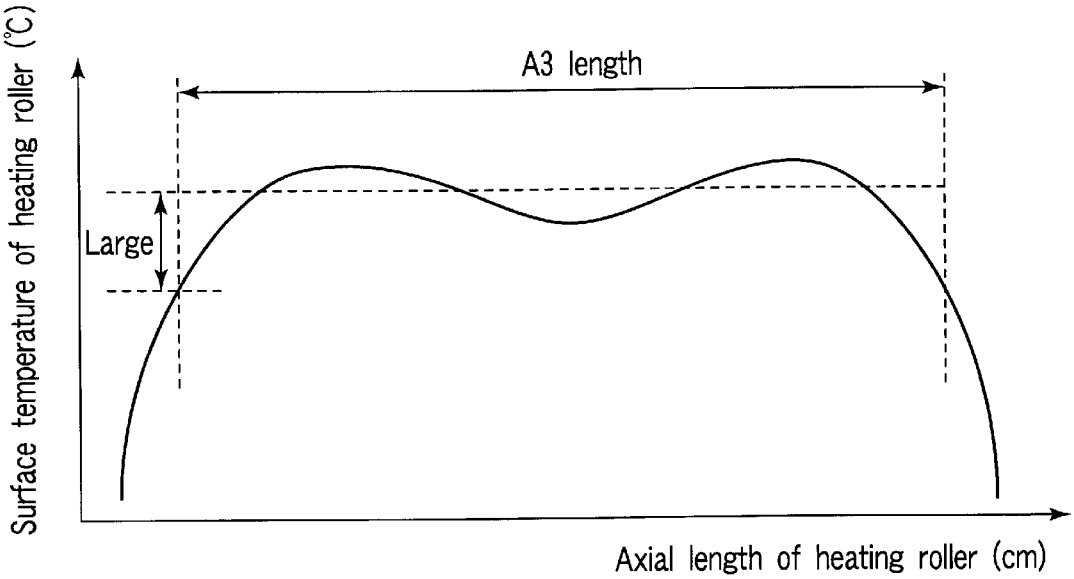
FIG. 14 is a graph showing how the temperature distribution of the surface of the heating roller is immediately after the warm-up operation.

With respect to the size of the induction-heating coil 10, it was described in relation to the first embodiment. As described, the coil ends increase in temperature if the size of the induction-heating coil 10 is greater than the width of sheets. For this reason, the induction-heating coil is comparatively narrow in width. With this structure, the heating roller 2 has such a surface temperature distribution as shown in FIG. 14 immediately after the warm-up operation. As shown, the temperatures at the coil ends are low when maximal-size sheets are used.

To solve this problem, the present embodiment executes the following temperature control during the warm-up operation:

The surface temperature of the heating roller 2 is made to differ between the central portion and the end portions during the warm-up operation. To be more specific, the first setting temperature that is controlled by means of the thermistor 25*b* opposing the center coil unit 21*b* and the second setting temperature that is controlled by means of the thermistor 25*a* opposing the end coil units 21*a* and 21*c*, are determined in such a manner that the second setting temperature is higher than the first setting temperature. By this control, the uneven temperature distribution at the time of the warm-up operation can be suppressed to a minimum when maximal-size sheets are used.

Figure 15:
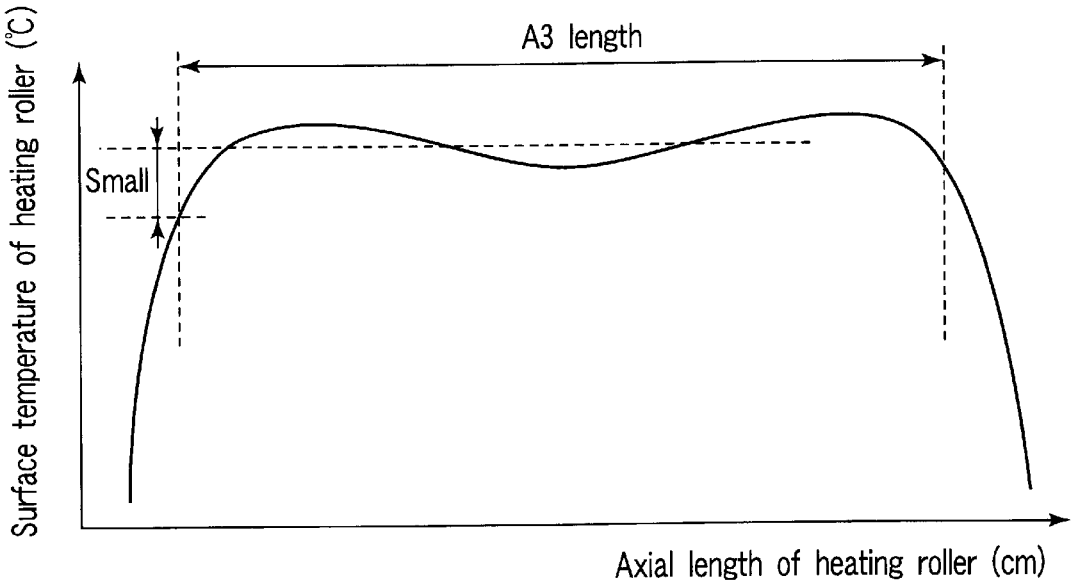
FIG. 15 is a graph showing how the temperature distribution of the surface of the heating roller is when the first setting temperature is 200° C. and the second setting temperature is 210° C.

FIG. 15 shows how the temperature distribution of the heating roller 2 is when the first and second setting temperatures are 200° C. and 210° C., respectively. As can be seen from this temperature distribution as well, the uneven temperature distribution can be suppressed in the warm-up operation when maximal-size sheets are used.

The temperature control described above is limited to the warm-up operation. In normal-operation modes (including a standby mode and a copying mode), the first and second setting temperatures are set at the same value.

Figure 16:
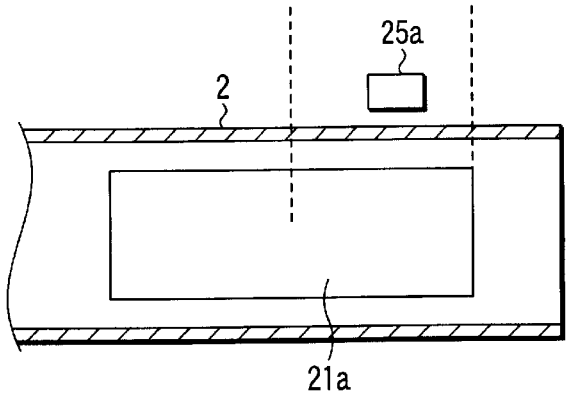
FIG. 16 shows another way for disposing a thermistor.

FIG. 16 shows another embodiment which suppresses the uneven temperature distribution the heating roller 2 may suffer at the time of the warm-up operation.

In this embodiment, the thermistor 25*a* opposing end coil unit 21*a* is arranged such that it is located on a more peripheral side than the center of the end coil unit 21*a*, i.e., at a position between the center and the periphery of the end coil unit 21*a*. In this case, the first and second setting temperatures are set at the same value, namely 200° C., and yet advantages similar to those described above are attained.

Figure 17:
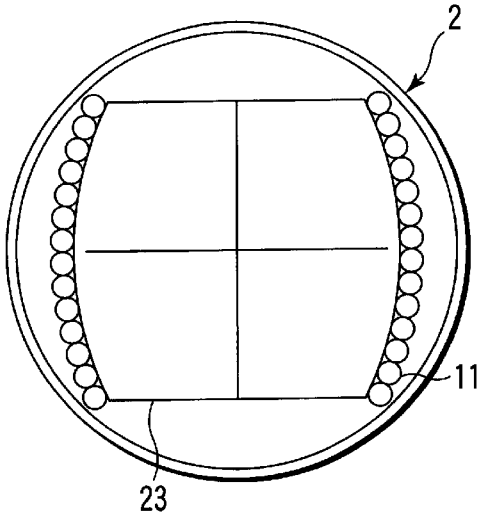
FIG. 17 shows another example of a bobbin around which an excitation coil is provided.

FIG. 17 shows the fifth embodiment of the present invention.

In this embodiment, the portion of the coil bobbin around which the excitation coil 11 is provided is shaped like a drum. With this structure, the excitation coil can be as close as possible to the inner circumferential surface of the heating roller 2. As a result, magnetic fluxes can be guided to the heating roller 2 with high efficiency, thereby improving the efficiency of induction heating.

The coil-wound portion of the coil bobbin 23 may be provided with a step or a groove (neither is shown) corresponding to the size of the wire. Where such a step or groove is provided, the wire can be wound easily.

Figure 18:
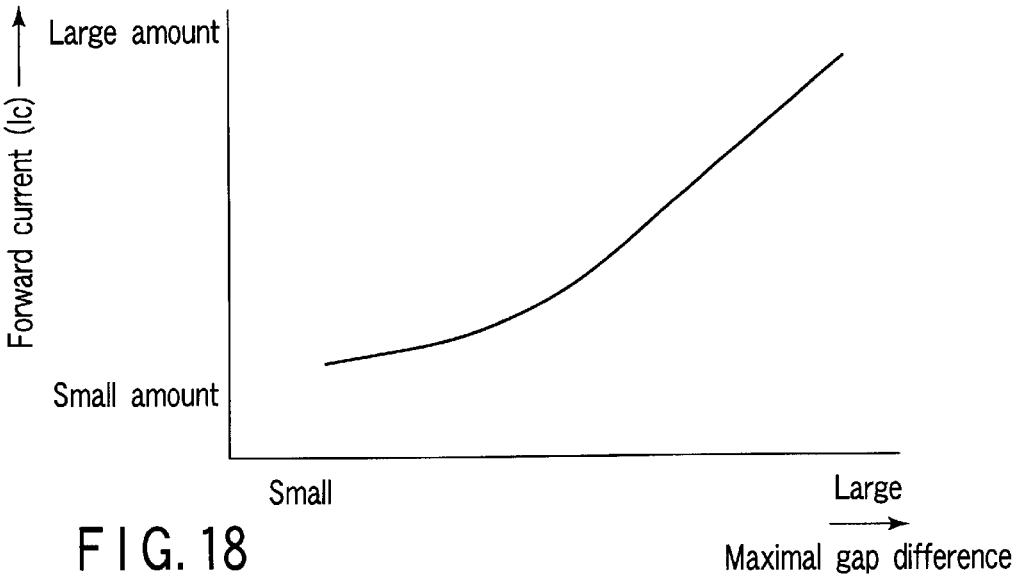
FIG. 18 is a graph showing how a maximal gap difference gives rise to an efficiency difference when minimal gaps between the excitation coil and the heating roller are set at the same value.

FIG. 18 shows how the heating efficiency is dependent on the maximal gap difference when the gaps at the minimal gap portions between the excitation coil 11 and the inner circumferential surface of the heating roller 2 are set at the same value. To be more specific, FIG. 18 is a graph illustrating how the forward current (Ic) of the IGBT (shown in FIG. 7) changes when 1,000W is output.

As should be clear from FIG. 18, where the gaps between the excitation coil 11 and the inner circumferential surface of the heating roller 2 are uniform, the amount of forward current of the IGBT 14 is small, and the efficiency is high.

Figure 19:
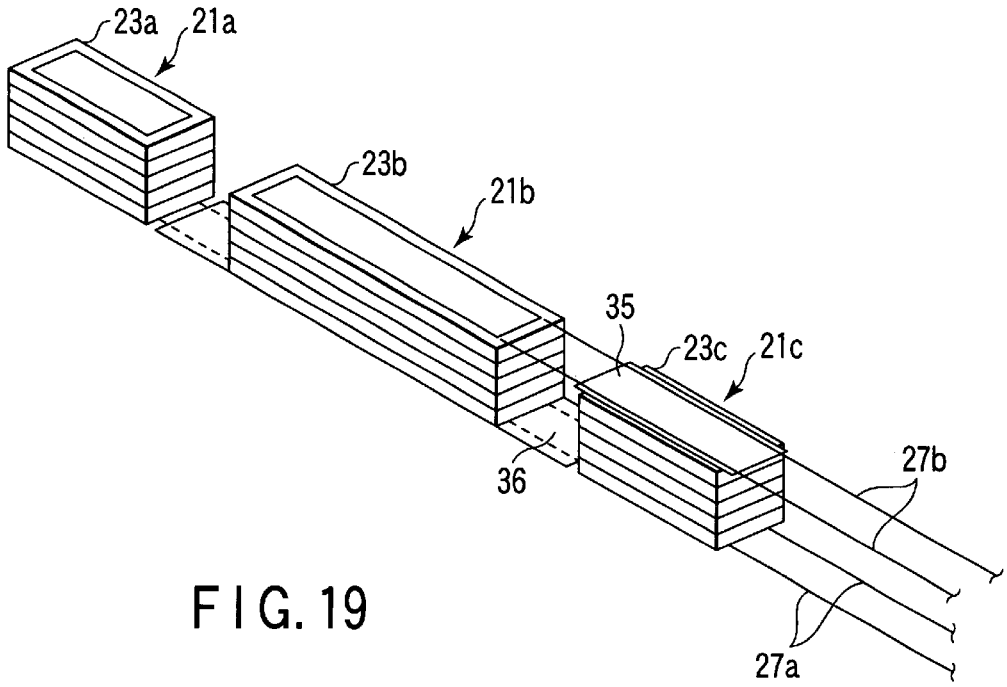
FIG. 19 is a perspective view of the center and end coil units whose lead wires are guided by a guide member.
Figure 20:
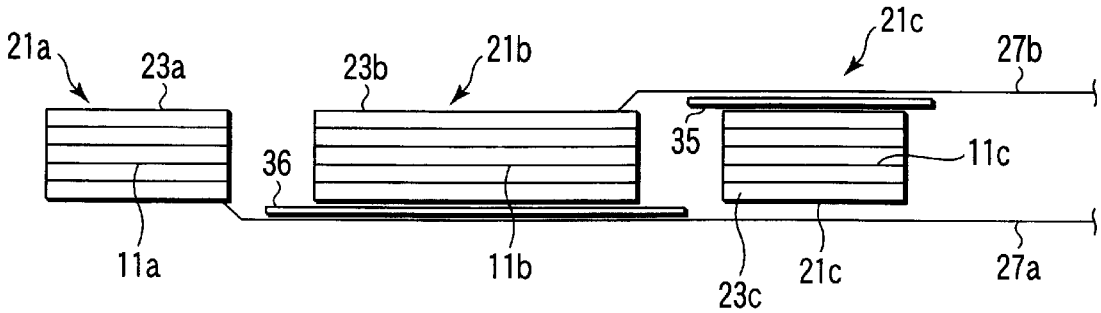
FIG. 20 is a front view of the center and end coil units shown in FIG. 19.

FIGS. 19 and 20 show the sixth embodiment of the present invention.

In the two-part induction-heating coils 10 of the embodiments described above, the lead wires 27*a* and 27*b* are arranged in such a manner that they do not have adverse effects on the coils.

Where the lead wires 27*b* of the center coil unit 21*b* along the upper surface of the end coil unit 21*c*, a wire guide 35 is provided on the upper surface of the end coil unit 21*c*. The wire guide 35 is an insulating guide member provided for the coil bobbin 23*c* and used for guiding the lead wires 27*b*. This structure suppresses the adverse effects caused by the lead wires 27*b*, with electrically insulating characteristics maintained.

Where the lead wires 27*a* existing between the end coil units 21*a* and 21*c* extend along the lower surface of the center coil unit 21*b*, a wire guide 36 is provided on the lower surface of the center coil unit 21*b*. The wire guide 36 is an insulating guide member provided for the center coil bobbin 23*b* and used for guiding the lead wires 27*a*. This structure suppresses the adverse effects caused by the lead wires 27*a*, with electrically insulating characteristics maintained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing device which includes a fixing roller and a pressing roller pressed against the fixing roller, the fixing roller and the pressing roller defining a region through which sheets of various sizes pass while being heated;

an induction-heating device which heats the fixing roller by induction heating and which includes first and second excitation coil units provided inside the fixing roller and spaced from each other by a predetermined distance in an axial direction of the fixing roller; and a control device which varies an output applied to the first and second excitation coils in accordance with a surface temperature as measured in the axial direction of the fixing roller, said first and second excitation coil units having widths which are greater than those of maximal-size sheets by 20 to 40 mm.

2. A fixing apparatus according to claim 1, wherein said first excitation coil unit includes a center coil unit located in an axially central portion of the fixing roller, and said second excitation coils include a pair of end coil units located at axially end portions of the fixing roller, and said center coil unit is away from the end coil units by a distance of 5 to 25 mm.

3. A fixing apparatus according to claim 2, wherein said pair of end coil units include coil sections formed with a single wire.

4. A fixing apparatus comprising:

a fixing device which includes a fixing roller and a pressing roller pressed against the fixing roller, the fixing roller and the pressing roller defining a region through which sheets of various sizes pass while being heated;

an induction-heating device which heats the fixing roller by induction heating and which includes first and second excitation coil units provided inside the fixing roller and spaced from each other by a predetermined distance in an axial direction of the fixing roller; and a control device which varies an output applied to the first and second excitation coils in accordance with a surface temperature as measured in the axial direction of the fixing roller, said first excitation coil unit including a center coil unit located in an axially central portion of the fixing roller, and said second excitation coil units including a pair of end coil units located at axially end portions of the fixing roller, and said center coil unit including a lead wire extending along one of said pair of end coil units, and the end coil unit along which the lead wire passes has coil turns smaller in number than that of a coil section of the other end coil unit.

5. A fixing apparatus according to claim 4, wherein the coil turns of the coil sections of said pair of end coil units differ from each other by 0.5 to 1.

6. A fixing apparatus comprising:

a fixing device which includes a fixing roller and a pressing roller pressed against the fixing roller, the fixing roller and the pressing roller defining a region through which sheets of various sizes pass while being heated;

an induction-heating device which heats the fixing roller by induction heating and which includes first and second excitation coil units provided inside the fixing roller and spaced from each other by a predetermined distance in an axial direction of the fixing roller; and a control device which varies an output applied to the first and second excitation coils in accordance with a surface temperature as measured in the axial direction of the fixing roller, said first excitation coil unit including a center coil unit located in an axially central portion of the fixing roller, and said second excitation coil units including a pair of end coil units located at axially end portions of the fixing roller, and said fixing apparatus further comprising: a first temperature sensing unit and an abnormal temperature sensing unit which oppose a fixing roller portion heated by the center coil unit; a second temperature sensing unit which opposes a fixing roller portion heated by one of the end coil units; and a second abnormal temperature sensing unit which opposes a fixing roller portion heated by the other one of the end coil units, the first and second temperature sensing units sensing setting temperatures of the center and end coil units, thereby controlling a heating operation performed by the fixing roller, wherein setting temperatures of the center and end coil units differ from each other during the warm-up operation.

7. A fixing apparatus according to claim 6, wherein said second temperature sensing unit opposes the end coil unit at a position located on a more peripheral side than the central portion of the end coil units.

8. A fixing apparatus comprising:

a fixing device which includes a fixing roller and a pressing roller pressed against the fixing roller, the fixing roller and the pressing roller defining a region through which sheets of various sizes pass while being heated;

an induction-heating device which heats the fixing roller by induction heating and which includes first and second excitation coil units provided inside the fixing roller and spaced from each other by a predetermined distance in an axial direction of the fixing roller; and a control device which varies an output applied to the first and second excitation coils in accordance with a surface temperature as measured in the axial direction of the fixing roller, said first excitation coil unit including a center coil unit located in an axially central portion of the fixing roller, and said second excitation coil units including a pair of end coil units located at axially end portions of the fixing roller, and each of said center coil unit and said pair of end coil units including a lead wire, the lead wire of the center coil unit extending through a region in the neighborhood of the end coil units, the lead wire of the end coil units extending through a region in the neighborhood of the center coil unit, and the lead wires of the center and end coil units being guided by an insulating guide member in the regions in the neighborhood of the center and end coil units.

* * * * *